US006116291A

United States Patent [19]

Hockemeyer et al.

[11] Patent Number: 6,116,291

[45] **Date of Patent: *Sep. 12, 2000**

[54] HALF HEALD OF A LENO SELVEDGE DEVICE WITH LIFTING HEALDS

[75] Inventors: Kurt Hockemeyer; Christoph Schwemmlein, both of Borken; Klaus Nowack, Bocholt, all of Germany

[73] Assignee: Klocker-Etwicklungs GmbH, Boerken, Germany

[ * ] Notice: This patent is subject to a terminal disclaimer.

[21] Appl. No.: 09/193,168

[22] Filed: Nov. 16, 1998

[30] Foreign Application Priority Data

Nov. 17, 1997 [DE] Germany ..... 197 50 804

[51] Int. Cl.[7] ..... D03C 7/02

[52] U.S. Cl. ..... 139/51; 139/52; 139/54

[58] Field of Search ..... 139/51, 52, 54

[56] References Cited

U.S. PATENT DOCUMENTS 4,967,802 11/1990 Klocker .
4,987,928 1/1991 Gaisser ..... 139/52
5,040,571 8/1991 Klocker et al. ..... 139/52

FOREIGN PATENT DOCUMENTS 0 282 874 9/1988 European Pat. Off. .
0 916 758 11/1998 European Pat. Off. .
3818680 6/1988 Germany .
8903775 3/1989 Germany .

*Primary Examiner*—Andy Falik
*Attorney, Agent, or Firm*—James P. Hanrath

[57] ABSTRACT

Half heald of a leno selvedge with lifting healds, whereas the half heald has two arms that may be joined together on their upper end so as to form a head and that are provided on their lower end with a foot, whereas the foot is magnetically co-operating with the at least one magnet of the lifting heald, and whereas the foot (70, 80) of the half heald (50) is given a shape that allows the magnetic force exerted onto the foot of the half heald in the stroke direction (arrow 100) of the lifting healds (2, 3) to be smaller than in the reverse direction, whereas the foot (70, 80) is provided with an upper end being designed as a border (71, 81) so that the half heald (59) is alternately magnetically brakable by the lifting healds (2, 3).

8 Claims, 4 Drawing Sheets

HALF HEALD OF A LENO SELVEDGE DEVICE WITH LIFTING HEALDS

BACKGROUND OF THE INVENTION

1. Field of the Invention

Half heald of a leno selvedge with lifting healds, whereas the half heald has two arms that may be joined together on their upper end so as to form a head and that are provided on their lower end with a foot, whereas the foot is magnetically co-operating with the at least one magnet of the lifting heald.

2. Description of the Prior Art

DE-GM 89 03 775 discloses a half heald made of metal, the foot of which being designed so as to have a full surface in order to be better controllable by the magnet of the lifting heald.

A leno selvedge device of the type mentioned above is sufficiently known out of DE-PS 38 18 680. The device for making a leno selvedge is hereby comprising two lifting healds arranged on two heald frames of a mechanical loom, said heald frames being moved alternately. The device for making a leno selvedge additionally comprises a half heald that is alternately taken along by the lifting healds according to the movement of the heald frames. The half heald has two arms that are joining on their upper end, thus creating a head with an eye for guiding the stationary thread. Such a half heald is made of a metallic material. Each lifting heald is provided on its lower end with at least one magnet which is causing the corresponding lifting heald to take along the half heald in a controlled way so that the force of the magnet guarantees that the half heald is held by the lifting heald while it is taken along by said lifting heald. This principle is, as already mentioned, sufficiently known out of DE-PS 38 18 680. The half heald is taken along by the lifting heald and here particularly by a web arranged in the lifting heald and on which the half heald is resting with its head located on the upper end of it while it is taken along by the corresponding lifting heald.

The above lifting heald was found to soon cut in the area of said web. This is essentially due to the high number of strokes of up to 1200 wefts and more which causes the half heald to strike onto the web at a very high velocity and with the corresponding high energy. In order to avoid such a cutting-in, it has already been suggested to insert a stopper underneath the magnet in the lifting heald, said stopper serving as a buffer for the foot of the half heald's arm. The wear in the area of the web could thus considerably be reduced and the working life of the lifting heald could considerable be extended, but the working life of said lifting heald was still to short, even with this stopper, especially with regard to the increasing number of strokes in mechanical looms.

SUMMARY OF THE INVENTION

The object of the present invention is therefore to provide a half heald of the type mentioned above that grants the lifting healds an increased working life even in very fast-running mechanical looms.

The solution of the invention is to provide the foot of the half heald with a shape that allows the magnetic force exerted onto the foot of the half heald in the stroke direction of the lifting healds to be smaller than in the reverse direction, whereas the foot is provided with an upper end being designed as a border so that the half heald is alternately magnetically brakable by the lifting healds.

Thanks to the special shape of the half heald's foot with its upper border, the magnetic resistance to the drifting away of the half heald against the stroke direction of the lifting heald is so much increased that in the end it is stronger than the resistance needed to take the foot of the half heald out of the magnetic field. That means that the magnetic force is continuously increasing when one foot of the half heald is dipping into the area of the lifting heald's magnet. This prevents the foot from striking through, that is, the half heald from bumping with its head located on its upper end onto the web of the lifting heald, whereas, when the other foot of the half heald is taken out of the area of the lifting heald's magnet, the resistance is smaller due to the continuous accretion of the magnetic mass occasioned by the shape of the foot. In other words, this entails that while the half heald is taken along by a lifting heald, the half heald is maintained in its original position in one of the lifting healds by the magnet. As a consequence, during this movement, the half heald is no more dipping into the one lifting heald and is no more coming to rest on the web of the one lifting heald—as this is the case with prior art. That means that the web of the lifting heald is no more exposed to wear so that in principle said web may also be omitted. That means that such a leno selvedge device comprising two lifting healds and one half heald is essentially working without wearing out.

The foot of the half heald has been designed so that it tapers downwards, i.e. against the stroke direction. The taper may hereby either occur in cross section or in the horizontal projection onto the foot of the lifting heald's arm. The important point is that the magnetic force is increasing from bottom to top due to the augmentation of magnetic material. From bottom to top means hereby from the lower end of the foot upwards in direction of the half heald's arm. The foot has hereby the advantageous shape of a triangle, whose vertex is pointed downwards onto the centre of the lifting heald's magnet. Towards the top, that means as an upper end, the foot is provided with the border. Thanks to the downwards taper of the foot, the force needed when the foot is taken out of the magnetic field of the magnet of the other lifting heald is smaller than the force that wants the foot to further dip into the one lifting heald against the stroke direction. This is so because, together with the foot's border, which is advantageously extending over essentially the whole width or the diameter of the magnet, the resistance required to overcome this border is higher than conversely the resistance needed to take (in stroke direction) the foot out of the magnetic field, since the resistance is continuously decreasing due to the taper of the foot, whereas the resistance needed to overcome the border, although abruptly diminishing, is still, thanks to the abrupt transition, considerably higher.

According to a particular characteristic of the invention, the arm is cranked in its lower part for receiving the foot. Thus the foot may have on its upper end, i.e. in stroke direction, a free border, entailing the above-mentioned fact that thanks to this border, the corresponding magnetic resistance against a drifting away of the half heald against the stroke direction of the lifting heald is increased until it is higher than the resistance needed to take the half heald out of the magnetic field.

It has hereby particularly been foreseen that the arm is cranked outwards. That means that the curve made by cranking shows outwards. This has the advantage that there is more space available in the area of the lifting healds.

BRIEF DESCRIPTION OF THE DRAWINGS

The invention is explained in more details according to the drawing.

DESCRIPTION OF THE PREFERRED EMBODIMENTS

Figure 1:
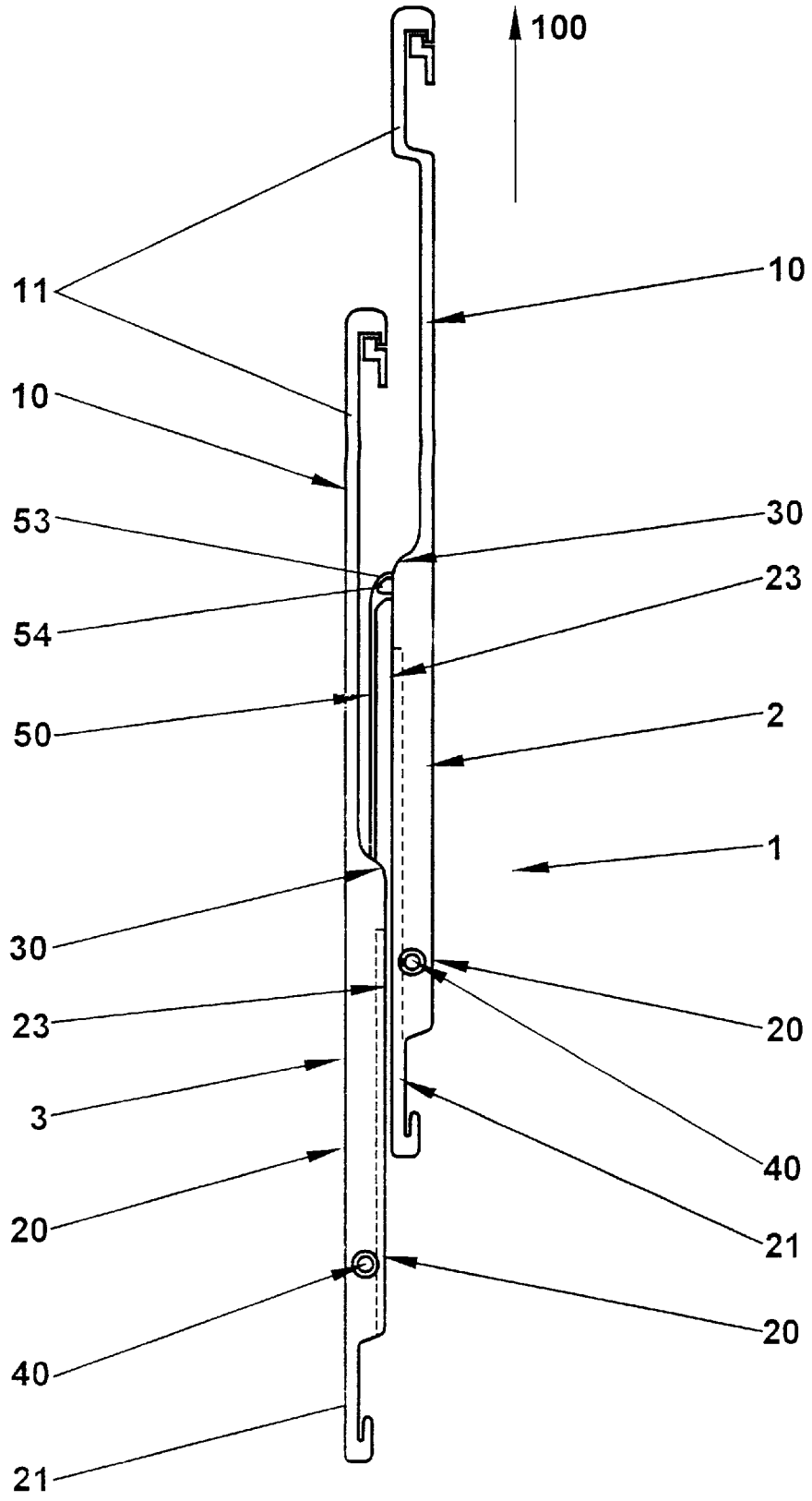
FIG. 1 shows a complete device for making a leno selvedge with two lifting healds and one half heald.

The device 1 to make a leno selvedge comprises two lifting healds 2, 3, that are joinable by means of alternately moved heald frames and that are alternately taking along the half heald 50. The operating principle is known out of DE-PS 38 18 680 for example to which explicit reference is made. Each lifting heald 2, 3 is essentially comprising two arms 10, 20, whereas each of these arms 10, 20 is provided with a hooked element 11 and 21 respectively for fastening onto the ridge bars for the healds (not shown) of the corresponding alternately moved heald frames of the mechanical loom.

Figure 4:
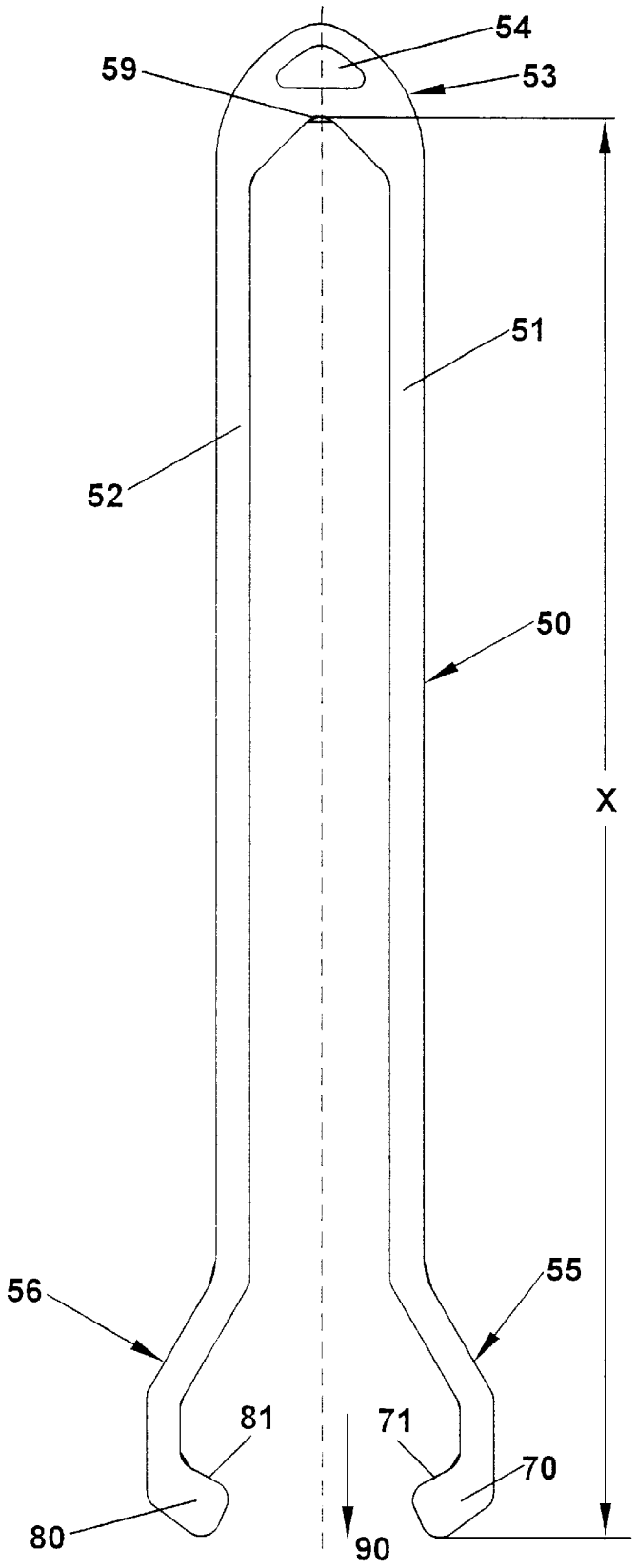
FIG. 4 shows the half heald enlarged.

The half heald 50 represented in FIG. 4 is showing two arms 51, 52, that are joining together on their upper ends, thus forming a head 53. The head 53 has an eye 54 that receives the stationary thread guided by the half heald 50. The arms 51, 52 are each cranked on their lower end so as to form a foot 70, 80. The cranking (arrow 55, 56) is hereby chosen so that the curve is showing outwards, causing the feet 70, 80 to show inwards. The feet 70, 80 are hereby designed so that they taper downwards (arrow 90) and that they are forming a border 71, 81 on their top part. Further embodiments of the foot may be seen in FIGS. 5 to 8.

Figure 3:
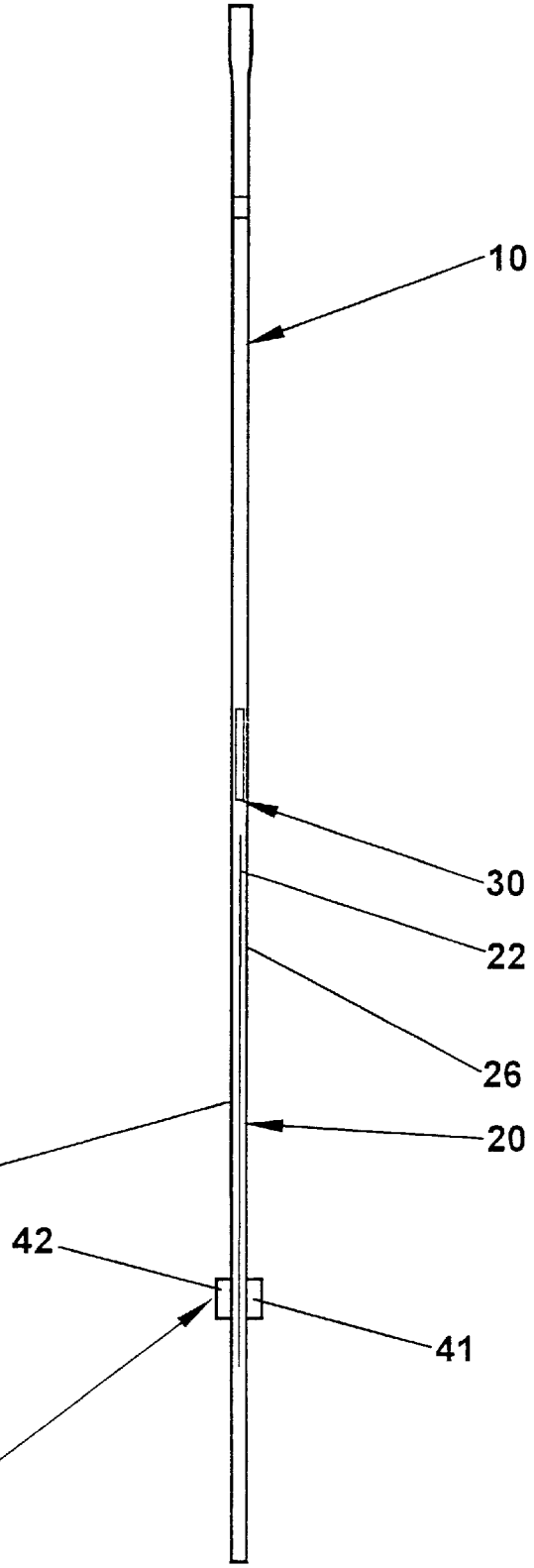
FIG. 3 shows the lifting heald according to FIG. 2 seen according to arrow III of FIG. 2.

The arm 20 of lifting heald 2, 3 is showing a slot 22 for the slidable reception of the arm 51, 52 of half heald 50 (FIG. 3). At the upper end of arm 20 a guiding aperture 30 is provided, said aperture representing, for the arms 51, 52 of half heald 50, the access to the slot 22 of arm 20. This brings about that the arm 20 is principally consisting, in forming the slot 22, of two walls 25, 26 that are held together on a longitudinal side of the slot, thereby forming the web 23.

Figure 2:
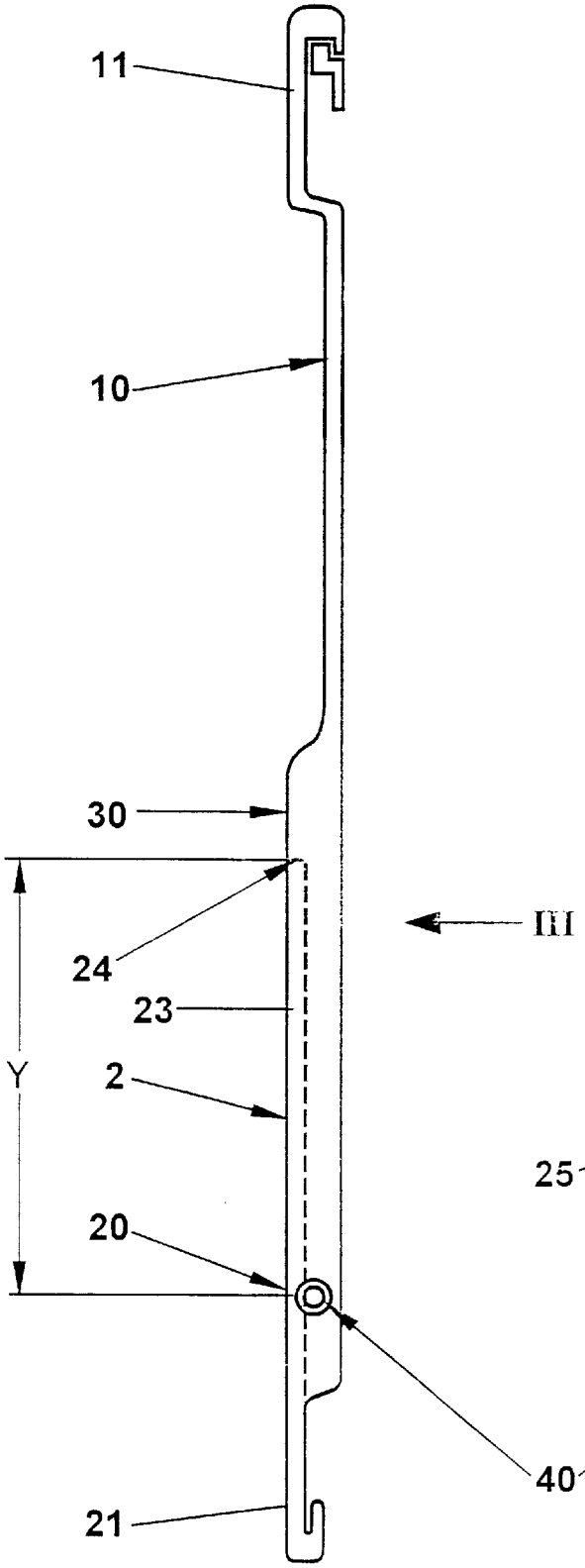
FIG. 2 is a lateral view of a lifting heald.

In the lower part of the arm 20, each lifting heald is having one magnet couple 40 for the movement control of the half heald 50 by the lifting healds 2, 3. Such a magnet couple 40 is consisting in two magnets 41, 42 that are arranged opposed to one another in the walls 25, 26 of the arm 20 of lifting heald 2, 3. The important point is that the length X of arm 51, 52 of the half heald 50 is bigger than the space Y between the magnet couple 40 and the upper border 24 of the web 23 (FIG. 2). Thanks to this point, the half heald 50 is no more coming to rest onto the end of the web 24 with its head and here particularly with the roof-shaped junction web 59.

Figure 5:
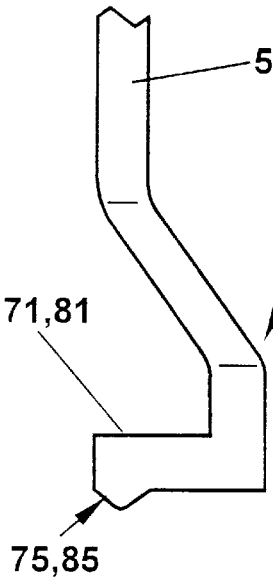
FIG. 5 to FIG. 8 show different embodiments of the foot of a half heald's arm.

The foot represented in FIG. 5 has been provided with a projection 75, 85 rotating conically or tapered downwards, guaranteeing thus a continuous augmentation of material.

Figure 6:
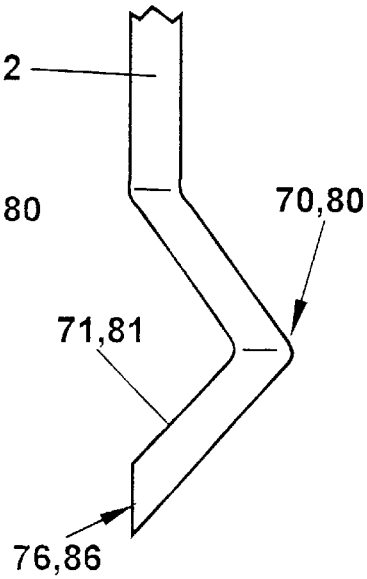

The foot according to FIG. 6 has been given a point allowing also a continuous augmentation of material.

Figures 7A, 7B:
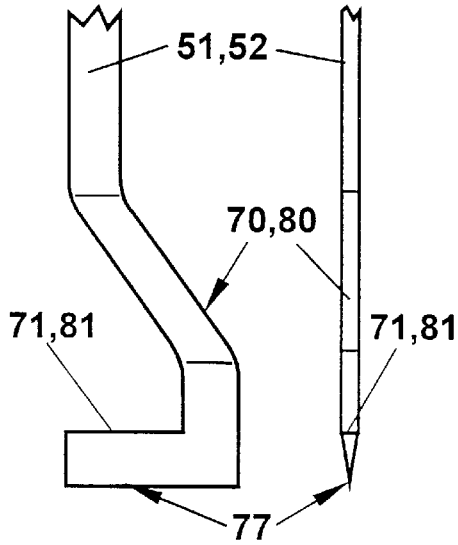

The same is true for the foot according to the FIGS. 7*a* and 7*b*, whereas here the foot is forming in cross section a point 77 reaching downwards, so that the cross section is getting smaller towards the bottom.

All the embodiments of various feet are provided with a border 71, 81.

Figures 8A, 8B:
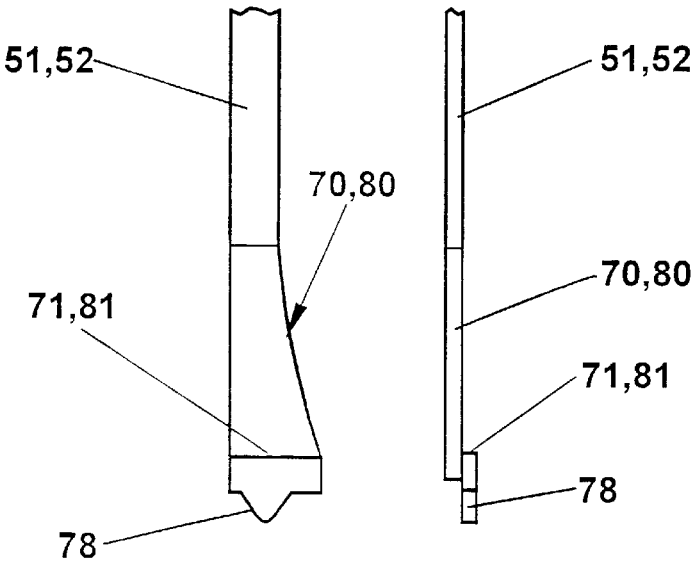

The representation according to FIGS. 8*a*, 8*b* is differing from the other embodiments in that here, the arm of the half heald is made of non-magnetic material, whereas the point 78 is made of magnetic material. The border 71, 81 is thus formed by the transition from the non-magnetic to the magnetic material. Here too, as already explained, the foot is conically shaped so as to form the point 78.

The way this device is operating is the following:

During the stroke movement (direction of stroke arrow 100) of the one lifting heald 2, the one arm 51 of the half heald 50 wants to dip further into the one lifting heald 2 against the stroke direction 100 due to the magnetic effect of the magnets 41, 42 of the other lifting heald 3. As already explained, the magnetic resistance, that is to say, the magnetic force that is exerted onto the foot 70 of the arm 51 of half heald 50 by the magnets 41, 42 of lifting heald 2 is bigger than the force required to take the foot 80 of arm 52 out of the other lifting heald 3. The direction of stroke is marked by the arrow 100. The border 71 of foot 70 of arm 51 of half heald 50 is offering a far bigger magnetic resistance than the magnetic resistance occurring when the downwards tapered foot 80 of arm 52 of the half heald is taken out of the area of the magnets 41, 42 of the other lifting heald. This is the case because, as already explained above, the foot 80 is tapered downwards in the direction indicated by arrow 90. The operation described above is happening exactly reverse when the lifting heald 2 is not lifted, as shown in FIG. 1, but alternately thereto the lifting heald 3.

I claim:

1. Half heald of a leno selvedge with lifting healds, whereas the half heald has two arms that may be joined together on their upper end so as to form a head and that are provided on their lower end with a foot, whereas the foot is magnetically co-operating with the at least one magnet of the lifting heald, characterized in that the foot (70, 80) of the half heald (50) is given a shape that allows the magnetic force exerted onto the foot of the half heald in the stroke direction (arrow 100) of the lifting healds (2, 3) to be smaller than in the reverse direction, whereas the foot (70, 80) is provided with an upper end being designed as a border (71, 81) so that the half heald (59) is alternately magnetically brakable by the lifting healds (2, 3).

2. Half heald according to claim 1, characterized in that the foot (70, 80) is tapered downwards.

3. Half heald according to claim 2, characterized in that the foot (70, 80) is tapered downwards in cross section.

4. Half heald according to claim 2, characterized in that the foot (70, 80) is tapered downwards in horizontal projection.

5. Half heald according to claim 1, characterized in that the arm (51, 52) is cranked in its lower part for receiving the foot (70, 80).

6. Half heald according to claim 1, characterized in that the arm (51, 52) is cranked outwards.

7. Half heald according to claim 1, characterized in that the border (71, 81) is essentially extending over the width of the magnet (41, 42) of the lifting heald (2, 3).

8. Half heald according to claim 2, characterized in that the foot (70, 80) is given the advantageous shape of a triangle, whereas the vertex of the triangle is pointed downwards onto the centre of the lifting heald's magnet (41, 42).

* * * * *

UNITED STATES PATENT AND TRADEMARK OFFICE

CERTIFICATE OF CORRECTION

PATENT NO. : 6,116,291
DATED : September 12, 2000
INVENTOR(S) : Hockemeyer et al.

It is certified that error appears in the above-identified patent and that said Letters Patent is hereby corrected as shown below:

In the Abstract Of The Disclosure:

1. At Line 1 delete "Half heald" and insert in lieu thereof -- A half heald --;

2. At Line 1 and 2 delete ", whereas the half heald has two arms" and insert in lieu thereof -- has a first arm and a second arm --;

3. At Line 3 after "head" add -- . --;

4. At Line 3 and 4 delete "and that are provided on their lower end with" and insert in lieu thereof -- Each of the arms have --;

5. At Line 4 after "a foot" add -- at their lower ends --;

6. At Line 4 delete ", whereas the foot" and insert in lieu thereof -- which --;

7. At Line 5 and 6 delete ", and whereas the " and insert in lieu thereof --. Each --;

8. At Line 6 and 7 delete "is given a" and insert in lieu thereof -- has --;

9. At Line 10 delete ", whereas the" and insert in lieu thereof --. Each --;

10. At Line 10 and 11 delete "is provided with an upper end being designed as"and insert in lieu thereof -- also has --.

11. At Line 11 after "a border" add -- at its upper end shaped --;

Specification:

12. At Column 3, Line 4 change "Figure 1 shows" to -- Figure 1 is alateral view and shows --;

13. At Column 3, Line 8 change "Figure 3 shows" to -- Figure 3 is a frontal view and shows --;

14. At Column 3, Line 10 change " Figure 4 shows" to -- Figure 4 is a frontal view and shows --;

15. At Column 3 delete lines 12 and 13 in their entirety and insert in lieu thereof -- Figures 5 , 6 , 7a , and 8a , are frontal views and Figures 7b and 8b are lateral views, all such Figures showing different embodiments of the foot of a half heald's arm. --

UNITED STATES PATENT AND TRADEMARK OFFICE

CERTIFICATE OF CORRECTION

PATENT NO. : 6,116,291
DATED : September 12, 2000
INVENTOR(S) : Hockemeyer et al.

It is certified that error appears in the above-identified patent and that said Letters Patent is hereby corrected as shown below:

16. At Column 3 Line 38 delete "is showing" and insert in lieu thereof -- shows --;

Claims:

17. At Claim 1 Line 2 delete "two arms" and insert in lieu thereof -- a first arm and a second arm --;

18. At Claim 1 Line 4 and 5 delete "is magnetically co-operating with the" and insert in lieu thereof -- is adapted to magnetically cooperate with --;

19. At Claim 1 Line 7 delete " is given" and insert in lieu thereof -- has --;

20. At Claim 1 Line 11 delete "being designed as" and insert in lieu thereof -- having --;

21. At Claim 1 Line 11 and 12 after "a border (71, 81)" insert -- with a shape --;

22. At Claim 1 Line 12 after "alternately" insert -- adapted to be --;

23. At Claim 2 Line 2 change "downwards" to -- downwardly --;

24. At Claim 3 Line 2 change " downwards" to -- downwardly --;

25. At Claim 4 Line 2 change "downwards" to -- downwardly --;

26. At Claim 5 Line 5 change "the arm" to -- one of said first or second arms --;

27. At Claim 6 Line 2 change " the arm" to -- one of said first or second arms --;

UNITED STATES PATENT AND TRADEMARK OFFICE

CERTIFICATE OF CORRECTION

PATENT NO. : 6,116,291
DATED : September 12, 2000
INVENTOR(S) : Hockemeyer et al.

It is certified that error appears in the above-identified patent and that said Letters Patent is hereby corrected as shown below:

28. At Claim 6 Line 2 change "outwards" to -- outwardly --;

29. At Claim 8 Line 2 delete " is given the advantageous" and insert in lieu thereof -- has the --;

30. At Claim 8 Line 3 to 4 change "downwards" to -- downwardly --;

31. At Claim 8 Line 4 change "centre" to -- center --;

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*